United States Patent [19]

Ueda

[11] 3,977,097

[45] Aug. 31, 1976

[54] DETACHABLE SPIKE ASSEMBLY FOR SHOES

[76] Inventor: Takeshi Ueda, No. 13-11, Kuruwa-cho, Isezaki, Gunma, Japan

[22] Filed: May 27, 1975

[21] Appl. No.: 581,414

[30] Foreign Application Priority Data

May 28, 1974 Japan ..... 49-60346

[52] U.S. Cl. ..... 36/67 D

[51] Int. Cl.[2] ..... A43C 15/00

[58] Field of Search ..... 36/67 R, 67 D, 59 R

[56] References Cited

UNITED STATES PATENTS

| | | | |
|---|---|---|---|
| 2,506,801 | 5/1950 | MacNeill | 36/67 D |
| 3,552,043 | 1/1971 | Moffa | 36/67 D |
| 3,882,614 | 5/1975 | Albaladejo | 36/67 D |

FOREIGN PATENTS OR APPLICATIONS

| | | | |
|---|---|---|---|
| 1,189,611 | 4/1970 | United Kingdom | 36/67 D |

*Primary Examiner*—Patrick D. Lawson

*Attorney, Agent, or Firm*—Haseltine, Lake & Waters

[57] ABSTRACT

A detachable spike assembly for shoes includes the combination of a spike element which is threaded at one end thereof and is tapered at the other end. A laterally-extending flange is provided integral with the spike element intermediate the ends thereof. An annular element is rotatably secured to the spike element between the flange and the threaded portion.

4 Claims, 8 Drawing Figures

DETACHABLE SPIKE ASSEMBLY FOR SHOES

BACKGROUND OF THE INVENTION

The present invention relates to detachable spike assemblies for shoes, particularly to such spike assemblies as are attached to golf shoes or other sports shoes.

It has previously been known to provide spikes of the aforesaid character with a ring member which is deformed into connecting relationship with the spike element while threading an upwardly projecting cup of the ring member for subsequent threading into a tapped aperture in the sole of the shoe to which the spike is to be connected. It has also been the practice to caulk the joint between the ring member and the spike element sometimes followed by a treatment for hardening the material including a quenching step. In such subsequent treatment the caulking between the ring member and the spike element is subject to being loosened and on occasion one or the other of the spike elements and the ring member are cracked.

Other disadvantages of prior spiked assemblies in which the ring member is secured fixedly to the spike elements included loosening of the joints between the ring member and the spike member so as to make it difficult or impossible to tighten the spike in the sole of the shoe, and the penetration of moisture into the joint with attendant rusting which makes replacement of the spikes difficult.

SUMMARY OF THE INVENTION

It is, therefore, a principal object of this invention to provide a detachable spike assembly wherein the spike element, once secured to the sole of the shoe, is not loosened by impairment of the joint between the spike element and an associated annular element.

It is another object of this invention to provide a detachable spike assembly which is not adversely effected by corrosion to the same extent as prior detachable spike assemblies.

It is still another object of this invention to provide a detachable spike assembly having improved durability over an extended period of use, having a capability for assembly with the shoe or disassembly therefrom and not adversely affected by weakening of the connection between the spike element and its associated annular element.

In accordance with the present invention there is provided a detachable spike assembly for shoes comprising in combination:

a spike element having an integrally formed laterally-extending flange intermediate the ends thereof, said spike element being provided with a threaded portion at one end thereof so as to be adapted for fastening to the sole of a shoe having a cooperable threaded portion;

and an annular element rotatably secured to said spike element between said flange and said threaded portion.

Other objects and advantages of the invention will become readily apparent to persons skilled in the art from the ensuing description of the invention.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
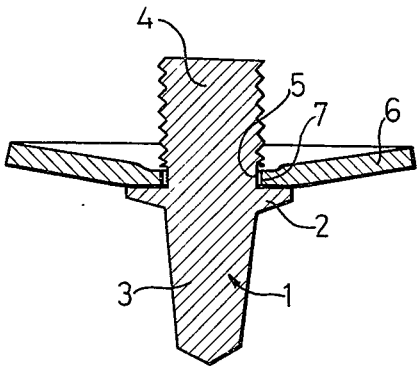
FIG. 1 is a side elevation, in cross-section, of a detachable spike assembly in accordance with the invention.

Referring to the drawings there is shown a detachable spike assembly which includes a spike element 1 and an annular element 6 secured rotatably to the spike element in the manner to be described below.

One end of the spike element, 3, is preferably tapered and provided with a point at the tip thereof. The other end of the spike element is provided with a threaded portion 4 for the purpose of securing the spike assembly to the sole of a shoe such as a golf shoe or other sports shoe. As is well known, the sole of the shoe is provided with a tapped hole for the reception of the threaded spike element.

The spike element is given a necked portion 5, and the diameter of the neck is less than the outer diameter of the threaded portion 4.

The spike element is given a laterally-extending flange 2 at an intermediate location between the ends of the spike element and adjacent the necked portion 5.

An annular element 6, preferably dish-shaped, is provided having a central aperture 7 which will permit positioning of the element over the threaded portion 4 of the spike element for seating on the flange 2 about the necked portion 5. Sufficient clearance is provided between the internal diameter of the central aperture of the annular element and the diameter of necked portion 5 to permit rotation of the annular element on the spike element. Once the annular element is so positioned the material, preferably the edge of aperture 7, is deformed so as to prevent the removal of the annular element from the spike and yet permit rotation thereon.

Figure 3:
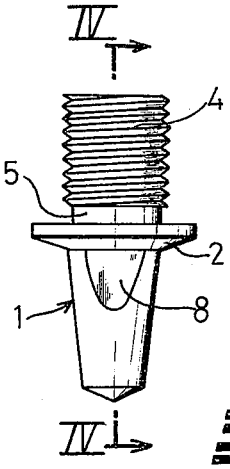
FIG. 3 is a side elevational view of the spike element of the assembly shown in FIG. 1.
Figure 4:
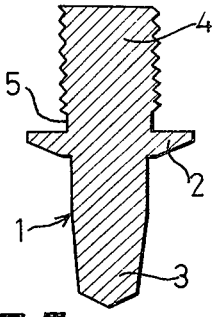
FIG. 4 is a cross-sectional view of the spike element taken along line IV—IV of FIG. 3.
Figure 2:
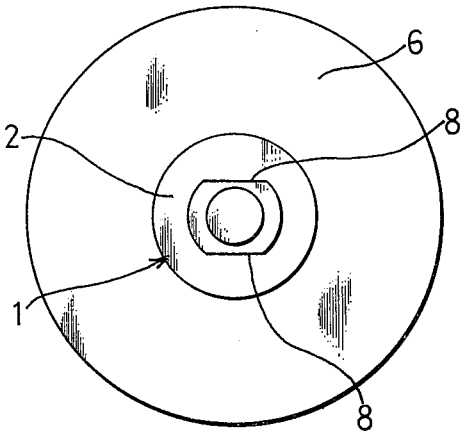
FIG. 2 is a bottom plan view of the assembly shown in FIG. 1.
Figure 5:
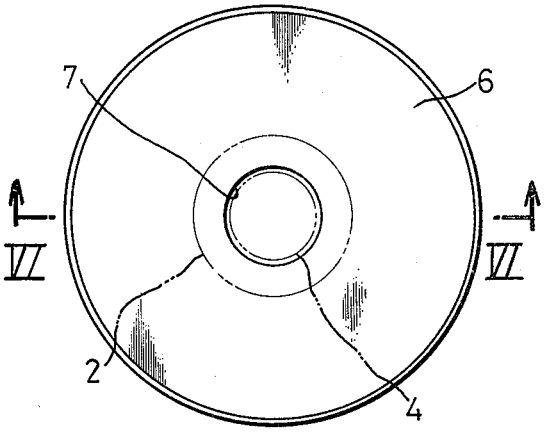
FIG. 5 is a top plan view of an annular element utilizable in the assembly shown in FIG. 1.

As shown in FIGS. 2 and 3, a non-circular segment 8, preferably configured to receive a conventional turning tool such as a wrench, is formed on the opposed sides of the spike element. As will be understood, one desiring to secure the spike assembly to the sole of a shoe need simply apply a turning tool to segment 8 and thereby thread the spike into the tapped aperture provided in the sole of the shoe.

Figure 7:
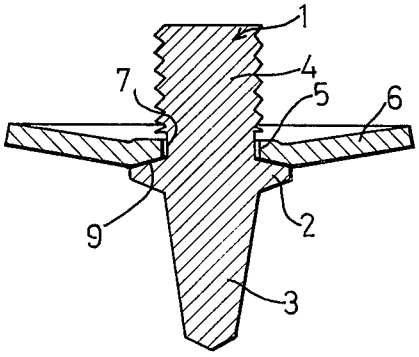
FIG. 7 is a cross-sectional view of a detachable spike assembly according to a further embodiment of the invention.
Figure 6:
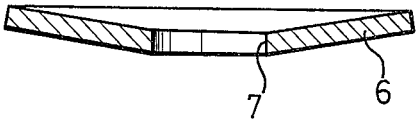
FIG. 6 is a side elevational view taken along line VI—VI of FIG. 5.
Figure 8:
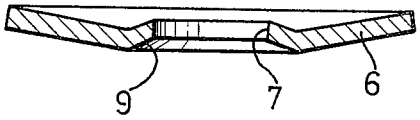
FIG. 8 is a side elevational view, in cross-section of the annular element employed in the assembly of FIG. 7.

FIG. 7 depicts an embodiment wherein complementary tapered portions are provided on the flange and the annular element so as to facilitate positioning of the annular element upon the spike element. In this manner accurate alignment of the annular element upon the spike element is easily accomplished.

The annular element 6 is preferably dish-shaped in order to provide the development of a spring force upon tightening of the spike element in the tapped aperture of the shoe. Such spring action tends to aid in the locking of threaded portion 4 in the sole of the shoe and thereby contributes to a more positive securement of the spike assembly with the shoe.

It will be appreciated that, unlike prior spike assemblies, the annular element 6 is not rotated against the surface of the shoe sole in assembling the spike to the shoe. This avoids any unnecessary abrasion of the bottom of the shoe sole with consequent damage thereto which may be occasioned by rotation of the annular element in securing the spike to the shoe as was previously necessary.

It is also to be recognized that since the spike according to the present invention is secured to the shoe sole through turning of the spike and its threaded portion, rather than the ring member of the prior devices by means of the holes provided therein, an area susceptible to the penetration of moisture has been eliminated since there are no holes in the annular element of the detachable spike assembly of this invention through which moisture may enter. There is likewise no need to caulk the joint between the annular element and the spike since the joint therebetween is not rigid as with the prior structures. Therefore, the possibility of a loosening of the caulking with an attendant weakening of the connection between the ring member and spike has been obviated. The spike element and annular element of the assembly disclosed herein can be subjected to a suitable hardening treatment prior to incorporation in the assembly so as to obtain an assembly which possesses substantial durability.

What I claim is:

1. A detachable spike assembly for shoes comprising in combination:

a spike element having an integrally formed flange extending laterally intermediate the ends thereof, said spike element being provided with a threaded portion at one end thereof so as to be adapted for fastening to the sole of a shoe having a cooperable threaded portion;

an annular element rotatably secured to said spike element between said flange and said threaded portion having a central aperture smaller than both the lateral dimention of said flange and the external diameter of said spike thread portion and deformed to secure same to said spike element about a necked portion thereof; and said necked portion being formed on said spike element adjacent said flange and having a diameter less than both the external diameter of the threaded portion of said spike element and the diameter of said aperture.

2. A detachable spike assembly as in claim 1, wherein there are provided complementary tapered portions on the upper surface of the flange and on the lower surface of the annular element to provide an abutting relationship and to facilitate positioning of said annular element on said spike element.

3. A detachable spike assembly as in claim 1, wherein there is provided a non-circular segment formed on opposed sides of said spike element for cooperation with a turning tool for threading said spike element into the sole of a shoe.

4. A detachable spike assembly as in claim 1, wherein said annular element is dish-shaped.

* * * * *